US010220417B2

(12) United States Patent
Ritondo

(10) Patent No.: US 10,220,417 B2
(45) Date of Patent: Mar. 5, 2019

(54) METHOD AND MACHINE FOR SORTING BAGS

(71) Applicant: Holweg Group, Molsheim (FR)

(72) Inventor: Cedric Ritondo, Eschau (FR)

(73) Assignee: HOLWEG GROUP, Molsheim (FR)

( * ) Notice: Subject to any disclaimer, the term of this patent is extended or adjusted under 35 U.S.C. 154(b) by 0 days.

(21) Appl. No.: 15/565,965

(22) PCT Filed: Apr. 7, 2016

(86) PCT No.: PCT/FR2016/050809
§ 371 (c)(1),
(2) Date: Jan. 15, 2018

(87) PCT Pub. No.: WO2016/166452
PCT Pub. Date: Oct. 20, 2016

(65) Prior Publication Data

US 2018/0154396 A1 Jun. 7, 2018

(30) Foreign Application Priority Data

Apr. 14, 2015 (FR) ..... 15 53245

(51) Int. Cl.
*B07C 5/02* (2006.01)
*B07C 5/12* (2006.01)
(Continued)

(52) U.S. Cl.
CPC ..... *B07C 5/12* (2013.01); *B07C 5/02* (2013.01); *B07C 5/06* (2013.01); *B07C 5/10* (2013.01);
(Continued)

(58) Field of Classification Search
CPC .... B07C 1/06; B07C 5/02; B07C 5/10; B07C 5/12; B07C 5/342; B65H 29/62; B65H 43/04; B65H 2701/191
See application file for complete search history.

(56) References Cited

U.S. PATENT DOCUMENTS 3,643,816 A * 2/1972 Jacobsen ..... B65G 37/005 271/218
3,712,468 A * 1/1973 Wenner ..... B07C 1/00 209/551
5,048,694 A 9/1991 Iwamoto
5,649,628 A * 7/1997 Stevens ..... B07C 1/00 209/534
5,794,788 A * 8/1998 Massen ..... B07C 5/126 209/524
(Continued)

FOREIGN PATENT DOCUMENTS

DE 1187051 2/1965
DE 40 14 130 11/1990
(Continued)

OTHER PUBLICATIONS

International Search Report dated Sep. 20, 2016 (6 pages including English translation) from PCT priority Application No. PCT/FR2016/050809.

*Primary Examiner* — Joseph C Rodriguez
(74) *Attorney, Agent, or Firm* — Brinks Gilson & Lione; John C. Freeman

(57) ABSTRACT

A method for sorting bags that includes filing past flat one after the other while being separated by a gap; the exterior edges of each bag are checked to determine whether a template and a position of the bag correspond to a calibrated bag or non-calibrated bag. The non-calibrated bags are ejected and the calibrated bags are presented in front of a visual inspection system to determine an acceptable or unacceptable quality of the inspected bag. The acceptable
(Continued)

bags are stacked and the unacceptable bags are rejected after they have passed in front of the visual inspection system.

15 Claims, 1 Drawing Sheet

(51) Int. Cl.

| | |
|---|---|
| ***B07C 5/342*** | (2006.01) |
| ***B65H 29/62*** | (2006.01) |
| ***B65H 43/04*** | (2006.01) |
| ***B07C 5/06*** | (2006.01) |
| ***B07C 5/10*** | (2006.01) |

(52) U.S. Cl.
CPC ..... *B07C 5/342* (2013.01); *B65H 29/62* (2013.01); *B65H 43/04* (2013.01); *B65H 2220/01* (2013.01); *B65H 2301/4473* (2013.01); *B65H 2301/4474* (2013.01); *B65H 2404/632* (2013.01); *B65H 2511/20* (2013.01); *B65H 2701/111* (2013.01); *B65H 2701/191* (2013.01)

(56) References Cited

U.S. PATENT DOCUMENTS

| | | | | |
|---|---|---|---|---|
| 5,842,577 | A * | 12/1998 | Stevens | G06K 9/186 209/3.3 |
| 8,393,472 | B2 * | 3/2013 | Hayduchok | B07C 5/02 209/3.2 |
| 2003/0188997 | A1 * | 10/2003 | Tan | H01L 21/67236 209/538 |
| 2008/0251429 | A1 | 10/2008 | Norris | |
| 2016/0267648 | A1 * | 9/2016 | Yamashita | G06T 5/009 |
| 2016/0354808 | A1 * | 12/2016 | Jing | B07C 5/342 |
| 2017/0307546 | A1 * | 10/2017 | Fukuda | G01N 21/958 |

FOREIGN PATENT DOCUMENTS

| | | |
|---|---|---|
| EP | 2 077 162 | 7/2009 |
| EP | 2 433 872 | 3/2012 |

* cited by examiner

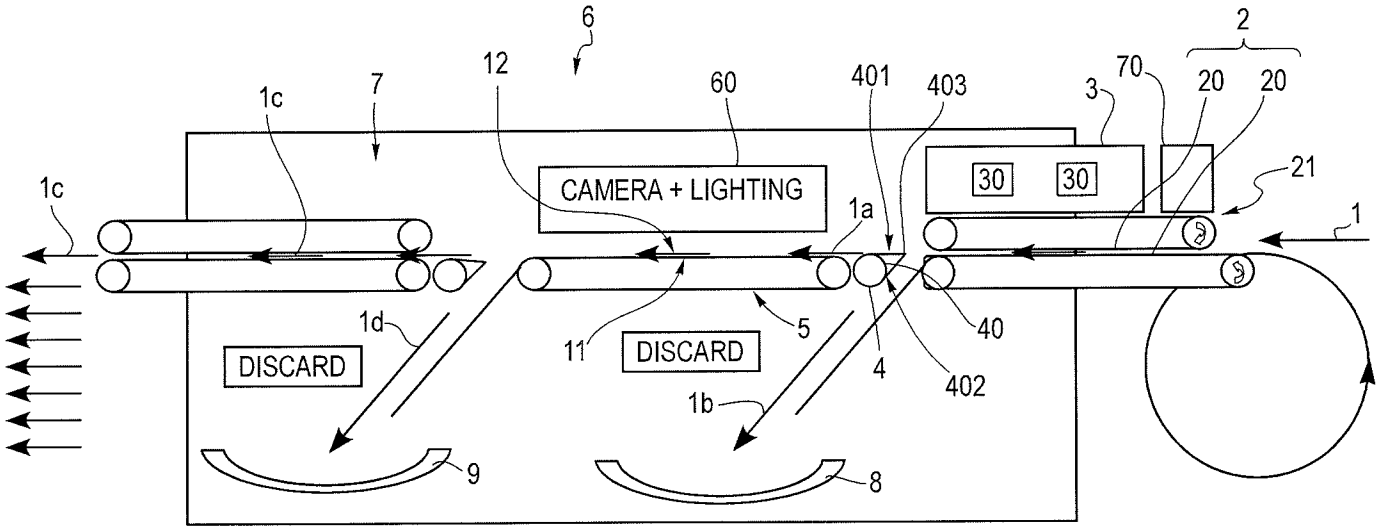
1
2
20
20
21
70
3
30
30
403
401
40
402
4
1a
5
60
CAMERA + LIGHTING
DISCARD
1b
8
6
11
12
7
1d
DISCARD
9
1c
1c

METHOD AND MACHINE FOR SORTING BAGS

This application claims priority to International Application No. PCT/FR2016/050809 filed Apr. 7, 2016 and to French Application No. 1553245 filed Apr. 14, 2015; the entire contents of each are incorporated herein by reference.

TECHNICAL FIELD

The present invention relates to a method for sorting bags, after their production, by a visual inspection system. It relates also to a sorting machine implementing said method.

STATE OF THE ART

The manufacturing of bags, such as paper bags for example, is performed on machines working continuously from a strip of material on a reel or from precut sheets on a stack, such as all-paper, or paper with parts of plastic material, on which folding, cutting and gluing operations are in particular carried out. The finished bags leave the machine, for example, flat one after the other separated by a gap before being received by a stacker device which forms stacks. The transporting of the bags is performed between pairs of rollers distributed over the path or by pairs of conveyor belts mounted in loop fashion and which run on either side of the bags.

The production rates can be high and reach several hundreds of pieces per minute.

It may be that, in transient start-up phases or when production parameters change, bags of poor quality are produced. Even if operators are monitoring the production, they cannot react instantaneously such that products of poor quality are mixed with products of good quality.

The document EP 2 433 872 proposes performing a poor quality bag detection operation, by interposing, between the production machine and the stacker device, a visual inspection system. The stacker device downstream of the inspection system comprises a sorting device for stacking only the bags that are considered acceptable by the visual inspection system. The unacceptable bags run on without being stacked and are collected later after having passed through the stacking zone. The inspection system comprises a station where the bags rest on just one side on conveyor belts, in order to allow a complete visual access to the face of the bag opposite the conveyor belts. This station comprises a lighting device and a camera or several cameras. It makes it possible to check various parameters, such as the presence of handles, their number, their position, the quality of the bottom fold of the bag, the quality of the printing or the presence of glue.

Such a system has proven effective in most cases. However, during the phases of adjustment, of restart after a stoppage, or in case of various incidents, it may be that the condition of the bag on leaving the machine is so poor that the bag cannot pass through the inspection system, particularly at the station in which the bag is supported by the conveyor belts only on one face, and it may cause a jam. It is then a matter of urgency to shut down the production to manually clear the jam.

DESCRIPTION OF THE INVENTION

The invention aims to provide a method and a machine for sorting by visual inspection which remedy these problems, in particular which do not introduce risks of jams when bags of very poor quality leave the production machine.

With these objectives in mind, the subject of the invention is a bag sorting method whereby:

bags are provided flat, filing one after the other while being separated by a gap;

each bag is presented in front of a visual inspection system to determine an acceptable or unacceptable quality of the bag inspected; and the acceptable bags are stacked and the unacceptable bags are rejected after they have passed in front of the visual inspection system;

the method being characterized in that, before the visual inspection, the outer edges of each bag are checked to determine whether the template and the position of the bag correspond to a calibrated bag or non-calibrated bag, the non-calibrated bags are ejected upstream of the visual inspection system, and the calibrated bags are presented to the visual inspection system.

According to the invention, a first sort is applied which can be implemented easily, for example by using cells such as optical, mechanical cells or capacitive, inductive or similar presence sensors, so as to determine whether the bag haves major defects with respect to its outer dimensions. In fact, the risks of jamming stem from bags with parts that are partially detached, folded back or torn. These defects are reflected by significant deviations from the template of the bag and are detected easily. This sort can be implemented while keeping the bag between the conveyor belts. The discarding of such bags greatly reduces the risks of jamming, particularly at the visual inspection system when the bags are less well held. The defect detection can also be performed in a complementary manner on the production machine, with, for example, glue presence sensors (based on humidity or heat in the case of hot glue).

According to one embodiment, a bag is determined to be non-calibrated if the width or the length of the bag is outside of a predetermined range. By determining the position of the longitudinal edges, the width of the bag is determined. If it is outside of an interval around the expected value, it is deduced therefore that the bag haves a defect and that it is not calibrated. Similarly, by determining the position of the front and rear edges, the length of the bag is determined. If the latter is outside of an interval around the expected value, it is deduced therefrom that the bag haves a defect, such as a badly cut edge, a badly folded back tab or a part torn away. The bag is then declared non-calibrated.

According to another embodiment, a bag is also determined to be non-calibrated if its front edge is separated from the rear edge of the preceding bag by a gap greater than a predetermined threshold. A distance greater than or less than the expected value is the sign of an anomaly on the bag which is thus declared non-calibrated.

According to yet another embodiment, a bag is determined to be non-calibrated if its front edge is separated from the rear edge of the preceding bag by an interval greater than a first predetermined threshold or less than a second predetermined threshold. Thus, the length of the bag is determined, which should lie between the first threshold and the second threshold to be considered to be that of a calibrated bag.

According to yet another embodiment, a bag is also declared non-calibrated if its thickness is greater than a predetermined threshold; for example, a device which is raised upon the passage of bags that are too thick activates a contactor and the bag is thus declared non-calibrated. An abnormal great thickness is generally linked to the superpositioning of layers of the constituent material in a nonconforming manner.

Another subject of the invention is a bag sorting machine comprising:

an input for receiving bags flat, filing one after the other while being separated by a gap;

a visual inspection system for making the bags file in front of an optical apparatus and for determining an acceptable or unacceptable quality of the bag inspected; and a selection system for rejecting the unacceptable bags and stacking the acceptable bags;

the machine being characterized in that it comprises a checking station between the input and the visual inspection system for checking the outer edges of each bag and determining whether the template and the position of the bag correspond to a calibrated or non-calibrated bag, and a switch upstream of the visual inspection system for ejecting the non-calibrated bags.

According to one constructive embodiment, the switch comprises a nose mounted to pivot about a transverse axis, the nose comprising an end and pivoting between a receded position in which the bags follow a path to the visual inspection system along an outer face of the nose, and a raised position in which the end of the nose protrudes to orient the front of the bag which is displaced on the side of an inner face of the nose opposite the outer face. The nose is interposed at the front of the non-calibrated bag to steer it to a path other than to the inspection system. The bag continues in its displacement, but taking the other path.

BRIEF DESCRIPTION OF THE FIGURES

The invention will be better understood and other particular features and advantages will become apparent on reading the following description, the description referring to:

FIG. 1 which is a schematic view of a sorting machine according to an embodiment of the invention.

DETAILED DESCRIPTION

A bag sorting machine according to the invention is represented in FIG. 1. The machine is designed to receive bags 1 at the output of a machine for manufacturing said bags 1 and comprises, in succession in the direction of displacement of the bags 1:

an input 21 for receiving bags 1 filing flat one after the other while being separated by a gap;

first transport means 2 for making the bags 1 run in front of a checking station 3 to check the outer edges of each bag and determine whether the template and the position of the bag correspond to a calibrated bag 1*a* or non-calibrated bag 1*b;* a switch 4 for ejecting the non-calibrated bags 1*b;* second transport means 5 for transporting the calibrated bags 1*a* to a visual inspection system 6 to make the calibrated bags 1*a* run in front of an optical apparatus 60 and to determine an acceptable or unacceptable quality of the bag inspected; and a selection system 7 for rejecting the unacceptable bags 1*d* and stacking the acceptable bags 1*c*.

The first transport means 2 are formed conventionally by pairs of conveyor belts 20 mounted in loop fashion and between which the bags 1 run. The checking station 3 comprises, for example, several photoelectric cells 30 emitting and receiving a light beam that can be interrupted by the bag to be checked. The edges of the bag in the direction of transportation must interrupt the beam of a first cell and not interrupt the beam of a second cell adjacent to the first, and do so within a time interval corresponding to the theoretical period of passage of the bag. If, during this interval, the beam from the second cell is interrupted or if the beam from the first cell is not, the bag is considered to have a defect. Other combinations of checks can be implemented. The first cell makes it possible to detect the gap between the front edge of a bag and the rear edge of the preceding bag. If this gap is greater than a predetermined threshold, the front edge of the bag is delayed and the bag is considered to have a defect. Note that the cells 30 shown in FIG. 1 are schematic representations only and are not to be interpreted as limiting the cells to a particular size, shape, orientation, or number.

It is also possible to check the thickness of the bag, which makes it possible to determine whether the bags have a major formation defect and to choose whether or not they should be immediately discarded. The check is, in this case, performed for example by a thickness checking device 70 that can include a feeler provided with a shoe, a roller bearing elastically on the filing bags or by a laser or ultrasound sensor. Note that the thickness checking device 70 shown in FIG. 1 is a schematic representation only and is not to be interpreted as limiting the device to a particular size, shape, or orientation with respect to other elements shown in FIG. 1.

Moreover, some of these checks can be performed upstream, on the manufacturing machine, the checking station receiving the nonconformity information by being able to determine the moment at which the non-calibrated bag passes the switch.

Downstream of the checking station 3, the switch 4 can be actuated rapidly according to the result supplied by the checking station 3. The switch 4 comprises a nose 40 mounted to pivot about a transverse axis between a receded position in which the calibrated bags 1*a* follow a path to the visual inspection system 6 along an outer face 401 of the nose 40, and a raised position in which an end of the nose 40 protrudes to steer the front of the non-calibrated bag 1*b* which is displaced on the side of an inner face 402 of the nose 40 opposite the outer face 401. The non-calibrated bags 1*b* are sent for example to a first recovery bin 8.

Calibrated bags 1*a* are taken over by the second transport means 5 to be brought to the visual inspection system 6. Contrary to the conventional transport means, the second transport means 5 support the bags 1*a* on just one face 11, such that the opposite face 12 is totally clear and visually accessible. The visual inspection system 6 determines whether the bag inspected is acceptable or not. The bag 1 is then delivered to the selection system 7 which is configured to stack the acceptable bags 1*c* and steer the unacceptable bags 1*d* to a second recovery bin 9.

The invention claimed is:

1. A bag sorting method comprising;

providing a first flat bag and a second flat bag that are separated by a gap;

presenting the first flat bag in front of a visual inspection system to determine an acceptable quality of the first flat bag or an unacceptable quality of the first flat bag, wherein if the first flat bag is determined to have the acceptable quality, the first flat bag is stacked with other flat bags that have the acceptable quality, and if the first flat bag is determined to have the unacceptable quality, the first flat bag is rejected;

wherein before the first flat bag is presented in front of the visual inspection, outer edges of the first flat bag are checked to determine whether a template and a position of the first flat bag correspond to either a calibrated bag or a non-calibrated bag, such that if the first flat bag corresponds to the non-calibrated bag, the first flat bag is ejected upstream of the visual inspection system, and if the first flat bag corresponds to the calibrated bag, the first flat bag is presented to the visual inspection system.

2. The method according to claim 1, wherein the first flat bag is determined to correspond to the non-calibrated bag if a width or a length of the first flat bag is outside of a predetermined range.

3. The method according to claim 1, wherein the checking of the outer edges of the first flat bag is performed by a checking station that comprises a first photoelectric cell and a second photoelectric cell positioned adjacent to the first photoelectric cell, wherein the first photoelectric cell emits and receives a first light beam that can be interrupted by the first flat bag to be checked and the second photoelectric cell emits and receives a second light beam that can be interrupted by the first flat bag to be checked, and wherein the checking the outer edges of the first flat bag comprises determining if the outer edges of the first flat bag in a direction of transportation of the first flat bag interrupt the first beam and not the second beam within a time period corresponding to a period of theoretic passage of the first flat bag and if the second beam is interrupted within the time period or if the first beam is not interrupted, the first flat bag is considered to have a defect.

4. The method according to claim 1, wherein the first flat bag is determined to correspond to the non-calibrated bag if a front edge for the first flat bag is separated from a rear edge of a preceding flat bag by a gap greater than a predetermined threshold.

5. The method according to claim 4, wherein the checking of the outer edges of the first flat bag is performed by a checking station that comprises a first photoelectric cell and a second photoelectric cell, wherein the first photoelectric cell emits and receives a first light beam that can be interrupted by the first flat bag to be checked and the second photoelectric cell emits and receives a second light beam that can be interrupted by the first flat bag to be checked, wherein the first photoelectric cell is arranged to detect a gap between a front edge of the first flat bag and the rear edge of a preceding second flat bag and wherein when checking the outer edges of the first flat bag and the second flat bag the first photoelectric cell detects the gap between the front edge of the first flat bag and the rear edge of the preceding second flat bag and if the gap detected is greater than a predetermined threshold, the first flat bag is considered to have a defect.

6. The method according to claim 1 wherein the first bag has a thickness and the first bag is determined to be non-calibrated when the thickness is greater than a predetermined threshold.

7. A bag sorting machine comprising:

an input for receiving a first bag and a second gag that are separated by a gap;

a visual inspection system that presents the first bag to pass in front of an optical apparatus for inspection and determines an acceptable quality of the inspected first bag or unacceptable quality of the inspected first bag; and a selection system that rejects the unacceptable first bag and stacks the acceptable first bag;

a checking station located between the input and the visual inspection system, wherein the checking station checks outer edges of the first bag and determines whether a template and a position of the first bag correspond to either a calibrated bag or a non-calibrated bag; and a switch upstream of the visual inspection system for ejecting the non-calibrated bag.

8. The machine according to claim 7, wherein the switch comprises a nose mounted to pivot about a transverse axis, the nose comprising:

an end and pivoting between a receded position in which the first bag follows a path to the visual inspection system along an outer face of the nose; and a raised position in which the end of the nose protrudes to orient a front of the first bag which is displaced on a side of an inner face of the nose opposite the outer face.

9. The machine according to claim 7 further comprising a checking station that comprises several cells to check outer edges of the first bag and to determine whether the template and the position of the first bag correspond to the calibrated bag or the non-calibrated bag.

10. The machine according to claim 9, wherein the several cells are selected from at least one of an optical cell, a mechanical cell, a capacitive sensor, or an inductive presence sensor.

11. The machine according to claim 9, wherein the several cells are photoelectric cells.

12. The machine as claimed according to claim 7 further comprising a thickness checking device to check a thickness of the first bag and when the thickness is greater than a predetermined threshold, the first bag is determined to be non-calibrated.

13. The machine according to claim 12, wherein the thickness checking device comprises either a feeler provided with a shoe or a roller bearing elastically on the first bag to check the thickness of the first bag.

14. The machine according to claim 12, wherein the thickness checking device comprises either a laser or ultrasound sensor to check the thickness of the first bag.

15. The method according to claim 1, wherein should the first flat bag be rejected after it being determined to have the unacceptable quality, the first flat bag is deemed unusable; and should the first flat bag be ejected upstream upstream of the visual inspection system, the first flat bag is deem unusable.

* * * * *